US010357870B2

(12) United States Patent
Hsieh

(10) Patent No.: US 10,357,870 B2
(45) Date of Patent: Jul. 23, 2019

(54) TORQUE SOCKET

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 220 days.

(21) Appl. No.: 15/489,758

(22) Filed: Apr. 18, 2017

(65) Prior Publication Data

US 2017/0312898 A1 Nov. 2, 2017

(30) Foreign Application Priority Data

Apr. 29, 2016 (TW) ..... 105113496 A

(51) Int. Cl.
*B25B 23/142* (2006.01)
*B25B 17/02* (2006.01)
*B25B 23/14* (2006.01)

(52) U.S. Cl.
CPC ..... *B25B 23/1427* (2013.01); *B25B 17/02* (2013.01); *B25B 23/141* (2013.01)

(58) Field of Classification Search
CPC .... B25B 17/02; B25B 23/141; B25B 23/1427
USPC ..... 81/474
See application file for complete search history.

(56) References Cited

U.S. PATENT DOCUMENTS 3,693,381 A * 9/1972 McGee ..... B25B 23/141 192/150
4,861,201 A * 8/1989 Cuilleron ..... B23B 31/1071 408/139
7,490,535 B2 * 2/2009 Ha ..... B25B 17/02 81/475
8,443,699 B2 * 5/2013 Ha ..... B25B 13/463 81/475
9,095,960 B2 * 8/2015 Kim ..... B25B 13/461

* cited by examiner

*Primary Examiner* — Hadi Shakeri
(74) *Attorney, Agent, or Firm* — CKC & Partners Co., LLC

(57) ABSTRACT

A torque socket is provided. The torque socket includes a release mechanism that can be released when a torque thereof reaches a pre-determined value. The torque socket also includes a transmission module. The transmission module includes transmission members and a transmission shaft that are coupled with the release mechanism. The transmission members are cooperated with the release mechanism to determine the transmission shaft transfer torque or not to automatically release the torque.

11 Claims, 6 Drawing Sheets

TORQUE SOCKET

RELATED APPLICATIONS

This application claims priority to Taiwan Application Serial Number 105113496, filed Apr. 29, 2016, which is herein incorporated by reference.

BACKGROUND

Technical Field

The present disclosure relates to a torque socket. More particularly, the present disclosure relates to a torque socket that has a release mechanism and can be automatically released when a torque thereof reaches a pre-determined value.

Description of Related Art

A torque wrench is a hand tool that is widely used in various walks of life. Compared to conventional fastening tools such as pincer plier, hex wrench, etc., the torque wrench can provide more precise controllability on the degree of fastening. Therefore, the torque wrench is popular on the assembly of components of vehicles such as ships, cars, aircrafts and mechanical stages.

A new kind of torque wrench has a functionality on releasing a torque when it reaches a determined value; therefore one-time-fastening can be achieved. However, as a hand tool, the torque wrench is commonly to be operated in various torque situations. Owing to the limitation of the arm strength of a human, a torque amplifier is developed to be cooperated with the torque wrench to increase the torque.

Although the torque can be enlarged by the torque amplifier, however, the torque amplifier can simply provide enlargement functionality, the user can only operate in accordance with the settings of the torque wrench. Therefore, some issues may be occurred when using the torque amplifier. For example, the user can only know the reduction ratio of the torque amplifier (directed to a theoretical torque amplification factor), the real torque value of the torque wrench is commonly determined at the time of usage. Therefore, there is a difference between a calculated value and a real value. Furthermore, the torque amplifier has no automatic release functionality. The torque of the torque amplifier will be stopped simply depends on the measurement value of the feedback torque from the torque wrench. However, different working steps may have different fastening requirements. Although the torque is released in the same feedback torque value, the torque may not reach the same standard value.

The aforementioned usage limitations will lead to the inconvenience of the operation procedure, and the required torque cannot be precisely ensured. In the assembly of the objects that require precise mechanical structure, such as ships, wings of aircrafts and turbines, a precise and constant torque is a critical of security. Since the conventional torque amplifier has no release functionality, there is a need to develop a new structure that can precisely reflect various situations of torque.

SUMMARY

According to one aspect of the present disclosure, a torque socket is provided. The torque socket includes an input base, a transmission module, a driving member, a release valve, a plurality of torque gears, a guiding base and a torque output member. The input base includes an input end, wherein the input end is connectable to a hand tool, and the input base is rotated by the hand tool. The transmission module includes a driving member, a transmission shaft and a plurality of transmission members. The driving member is connected and activated by the input base. The transmission shaft is accommodated in the driving member, wherein one end of the transmission shaft includes a transmission gear. The transmission members are limited by the transmission shaft, wherein the transmission members are linked with the driving member to rotate the transmission shaft. The release valve is contacted with the transmission members and is moved by the transmission members. The torque gears are limited by the torque socket, wherein the torque gears are disposed around the transmission shaft and are engaged with the transmission gear. The torque gears are linked by the transmission gear and are revolved around the transmission shaft. The torque output member includes an accommodating space for supporting the torque gears. The guiding base includes annular gears, wherein the transmission shaft is rotatably coupled to the guiding base, and the torque gears revolve against the annular gears thereby rotating the torque output member.

According to another aspect of the present disclosure, a torque socket is provided. The torque socket includes an input base, a transmission module, a release mechanism, a guiding base and a torque output member. The input base includes an input end, wherein the input end is connectable to a hand tool, and the input base is rotated by the hand tool. The transmission module includes a driving member, a transmission shaft and a plurality of transmission members. The driving member is connected and activated by the input base. The transmission shaft is accommodated in the driving member, wherein one end of the transmission shaft includes a transmission gear. The pluralities of transmission members are limited by the transmission shaft, wherein the transmission members are linked with the driving member to rotate the transmission shaft. The release mechanism is located between the input base and the transmission shaft. The release mechanism includes a release valve, an elastic member and an adjusting member. The release valve is contacted with the transmission members and is moved by the transmission members. The elastic member is contacted with the release valve and includes a restoring force. The adjusting member is contacted with the elastic member, wherein the adjusting member is moved to adjust the restoring force. The plurality of torque gears are limited by the torque socket, wherein the torque gears are disposed around the transmission shaft and are engaged with the transmission gear, the torque gears are linked by the transmission gear and are revolved around the transmission shaft. The torque output member includes an accommodating space for supporting the torque gears. The guiding base includes annular gears, wherein the transmission shaft is rotatably coupled to the guiding base, and the torque gears revolve against the annular gears thereby rotating the torque output member.

BRIEF DESCRIPTION OF THE DRAWINGS

The present disclosure can be more fully understood by reading the following detailed description of the embodiment, with reference made to the accompanying drawings as follows.

DETAILED DESCRIPTION

It is a purpose of the present disclosure to provide a torque socket that can solve issues of the conventional torque amplifiers of torque wrenches. A release mechanism is cooperated with a torque output member to sense a torque value. A pre-determined torque value is adjustable by the release mechanism. When a torque value reaches the pre-determined torque value, the torque socket will automatically stop to output the torque, thereby achieving automatic release functionality.

Figure 1:
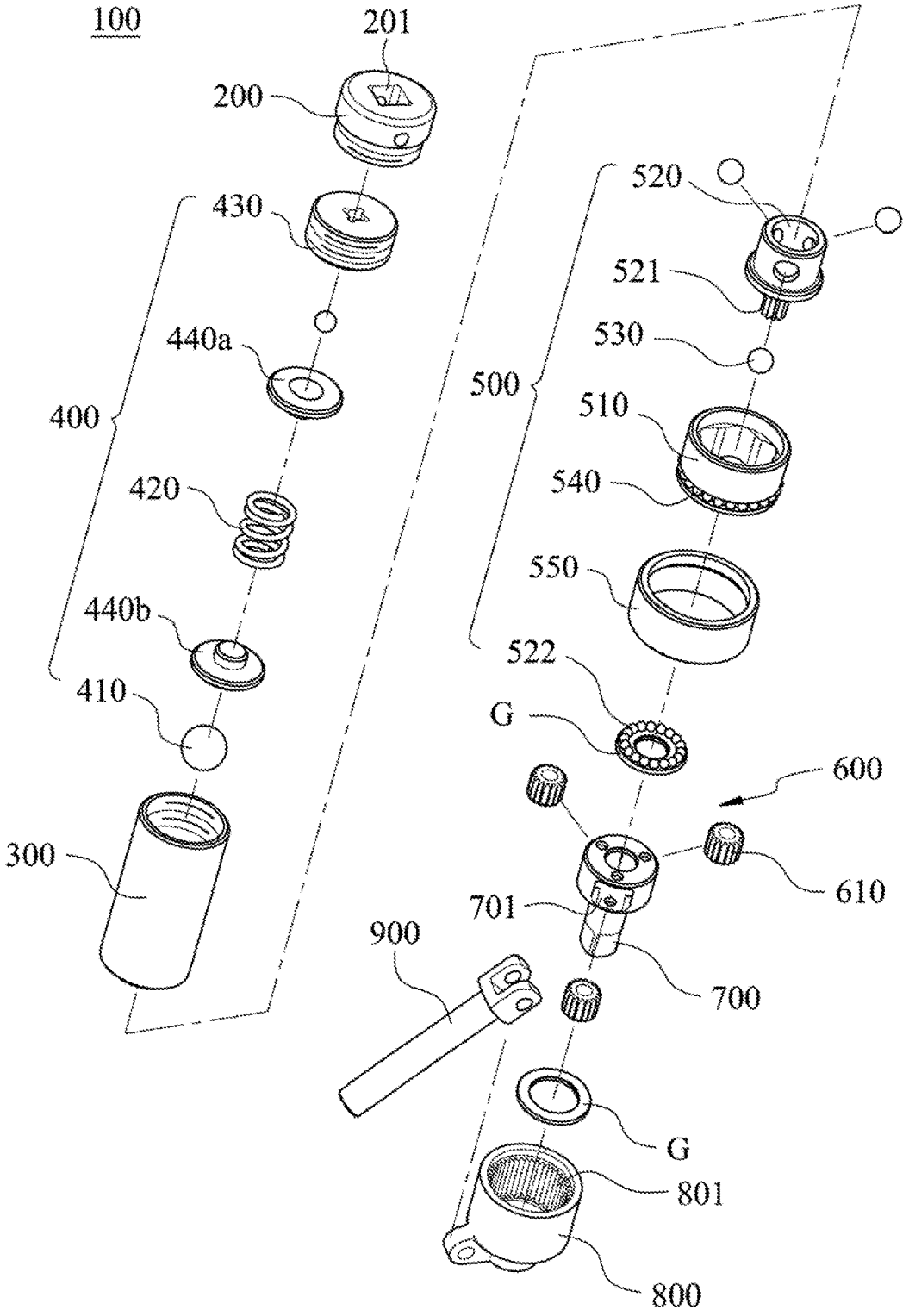
FIG. 1 is an exploded view of a torque socket according to one embodiment of the present disclosure.

FIG. 1 is an exploded view of a torque socket 100 according to one embodiment of the present disclosure.

The torque socket 100 includes an input base 200, a socket 300, a release mechanism 400, a transmission module 500, a torque gear set 600, a torque output member 700, a guiding base 800 and a positioning arm 900. The input base 200 includes an input end 201. The shape of the input end 201 is matched with a hand tool (not shown). The input end 201 is connected to the hand tool, thus the hand tool can rotate the input base 200. The hand tool can be a torque wrench or other hand tools having shapes correspondent with the input end 201. The socket 300 is connected at one side of the input base 200. The socket 300 and the input base 200 are connected fixedly and can transfer toque. The release mechanism 400 includes a release valve 410, an elastic member 420 and an adjusting member 430. The elastic member 420 and the adjusting member 430 are accommodated in the socket 300. The transmission module 500 includes a driving member 510, a transmission shaft 520, three transmission members 530, a plurality of balls 540 and a casing 550. The transmission shaft 520 includes a transmission gear 521 and a ball bearing 522. The ball bearing 522 is located at one side of the transmission shaft 520 and is penetrated by the transmission gear 521. The torque gear set 600 includes three torque gears 610. The torque gears 610 are limited and accommodated in the torque output member 700. Two backing rings G can be disposed at two sides of the torque output member 700 for providing a buffering effect. The transmission shaft 520 is rotationally coupled to the guiding base 800. The torque output member 700 and the torque gear set 600 are accommodated in the guiding base 800, and a plurality of annular gears 801 are disposed in an inner side of the guiding base 800. The positioning arm 900 is connected to the guiding base 800. The positioning arm 900 is held to position the guiding base 800. Furthermore, the input end 201, the transmission shaft 520 and the torque output member 700 are disposed coaxially.

Figure 2:
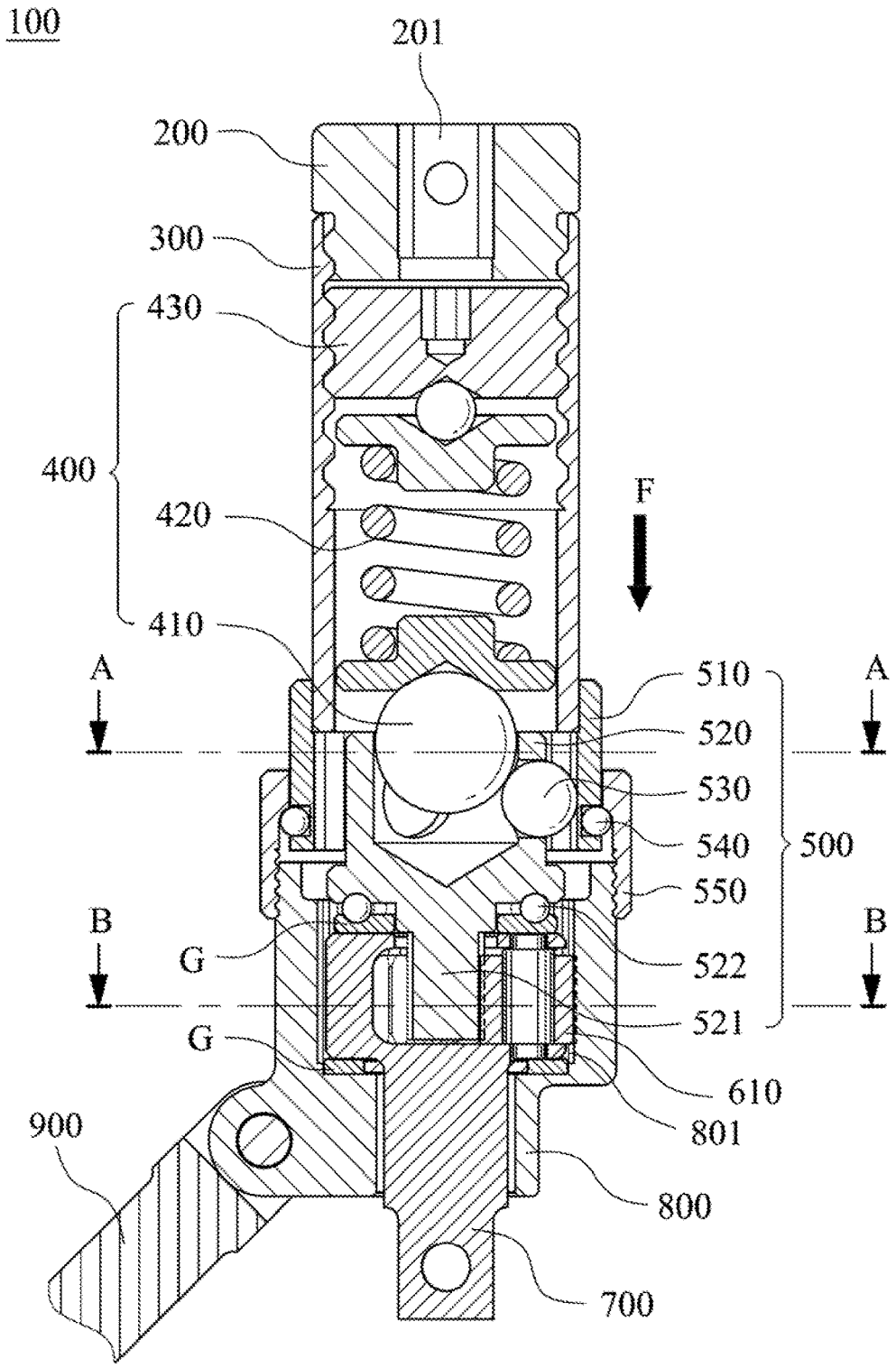
FIG. 2 is a cross-sectional view of the torque socket of FIG. 1.

FIG. 2 is a cross-sectional view of the torque socket 100 of FIG. 1. The socket 300 is connected to the input base 200 and transfers a torque generated from the rotation of the input base 200. The release mechanism 400 is disposed in the socket 300, and the release valve 410, the elastic member 420 and the adjusting member 430 are connected in sequence. In the embodiment, the release valve 410 is a ball and is accommodated in a circular groove of the transmission shaft 520, and the circular groove has a correspondent shape with the ball. In FIGS. 1 and 2, the elastic member 420 can be assembled between a top plate 440*a* and a bottom plate 440*b*. The top plate 440*a* has a shape correspondent to the adjusting member 430 and the bottom plate 440*b* has a shape correspondent to the release valve 410. In this arrangement, the elastic member 420 can be easily assembled and a strength transmission of the release mechanism 400 can be more stable.

In FIG. 1, it is shown that in addition to a hollow circular groove, the transmission shaft 520 includes three holes communicated with the hollow circular groove, and the three holes are for accommodating and limiting the transmission members 530. In FIG. 2, it is also shown that the release valve 410 is accommodated in the circular groove of the transmission shaft 520 and is tangentially against the transmission members 530. The release valve 410, the transmission members 530 and the transmission shaft 520 are all accommodated in the driving member 510. The balls 540 are around the bottom of the driving member 510 and are against a casing 550. The casing 550 is fixed on the guiding base 800. The input base 200, the socket 300 and the driving member 510 can be fixedly connected by screwing or welding, or can be integrally formed; and the driving member 510 can be activated by the input base 200. Therefore, when a user rotates the input base 200, the driving member 510 is limited by the balls 540, thus the components of the transmission system (such as the input base 200, the driving member 510, etc.) will not be escaped from the casing 550 and can rotate relative to the casing 550 (torque socket 100).

The details of the release mechanism 400 are described thereafter. Although the input base 200 and the socket 300 are fixedly connected, however, the adjusting member 430 can be moved in the socket 300 for adjusting the amount of compression of the elastic member 420. In one example, a plurality of screw threads can be formed in an inner side of the socket 300, and a tool can be inserted into the input end 201 to adjust the adjusting member 430, thereby precisely adjusting the amount of compression of the elastic member 420. Since a pushing block located between the adjusting member 430 and the elastic member 420 is ball-shaped and can be rotated, the compression controllability of the elastic member 420 will not be influenced.

Figure 3:
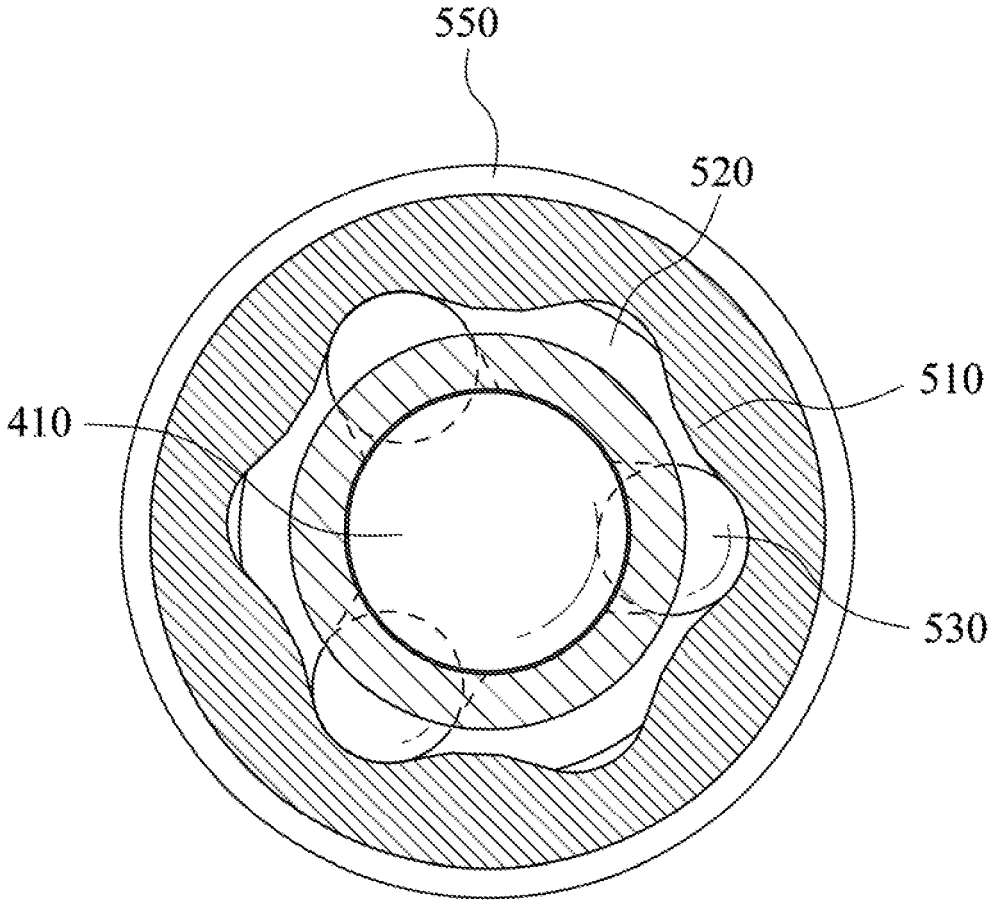
FIG. 3 is a schematic view showing a transmission between a driving member and a transmission member of the torque socket of FIG. 1.

FIG. 3 is a schematic view showing a transmission between a driving member 510 and a transmission member 530 of the torque socket 100 of FIG. 1. FIG. 3 is a cross-sectional view along A-A line of FIG. 2. In FIG. 3, an inner side of the driving member 510 is hollow and includes a plurality of inner teeth, the transmission member 530 is engaged with the inner teeth, and the transmission member 530 pushes the transmission shaft 520 to rotate. Since the driving member 510 and the transmission member 530 are contacted in a curved surface and can be freely rolled; the transmission member 530 tends to be escaped from the inner teeth when the driving member 510 rotates. However, the release valve 410 constantly suppresses the transmission member 530, and the transmission member 530 cannot be fully moved to a groove of the transmission shaft 520. Therefore, the torque transmission between the driving member 510 and the transmission shaft 520 can be kept.

Figure 4:
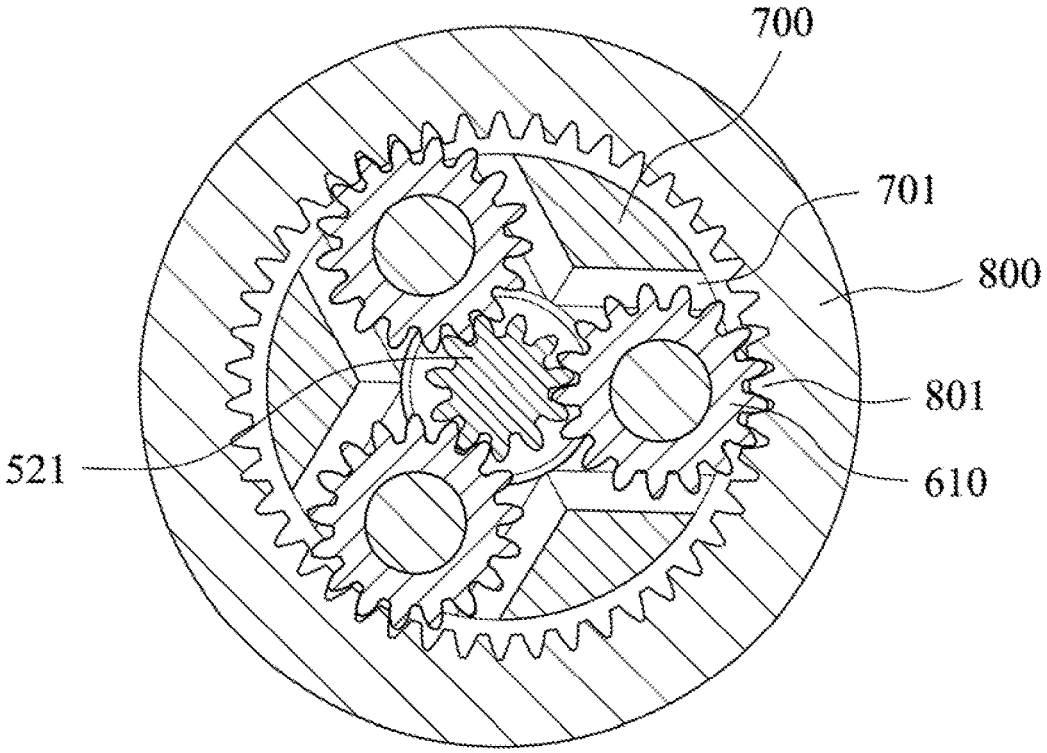
FIG. 4 is a schematic view showing a transmission between a transmission gear and a torque gear of the torque socket of FIG. 1.

FIG. 4 is a schematic view showing a transmission between a transmission gear 521 and a torque gear 610 of the torque socket 100 of FIG. 1. FIG. 4 is a cross-sectional view along B-B line of FIG. 2. The transmission gear 521, the torque gear set 600 and the torque output member 700 are acted as another transmission system of the torque socket 100 of the present disclosure. The transmission gear 521 is inserted into a middle space of the torque gear set 600, and three torque gears 610 are engaged with inner annular teeth 801 of the guiding base 800, thereby forming a planetary gear set. Furthermore, the positioning arm 900 is connected to the guiding base 800 and is hold by the user. Therefore, the guiding base 800 can be viewed as being fixed in the planetary gear set. The torque output member 700 includes an accommodating space 701, three torque gears 610 are accommodated in the accommodating space 701. When the transmission gear 521 is rotated by a torque from the front end, the torque gears 610 are revolved against the annular gears 801 of the guiding base 800, thereby rotating the torque output member 700.

Figure 5A:
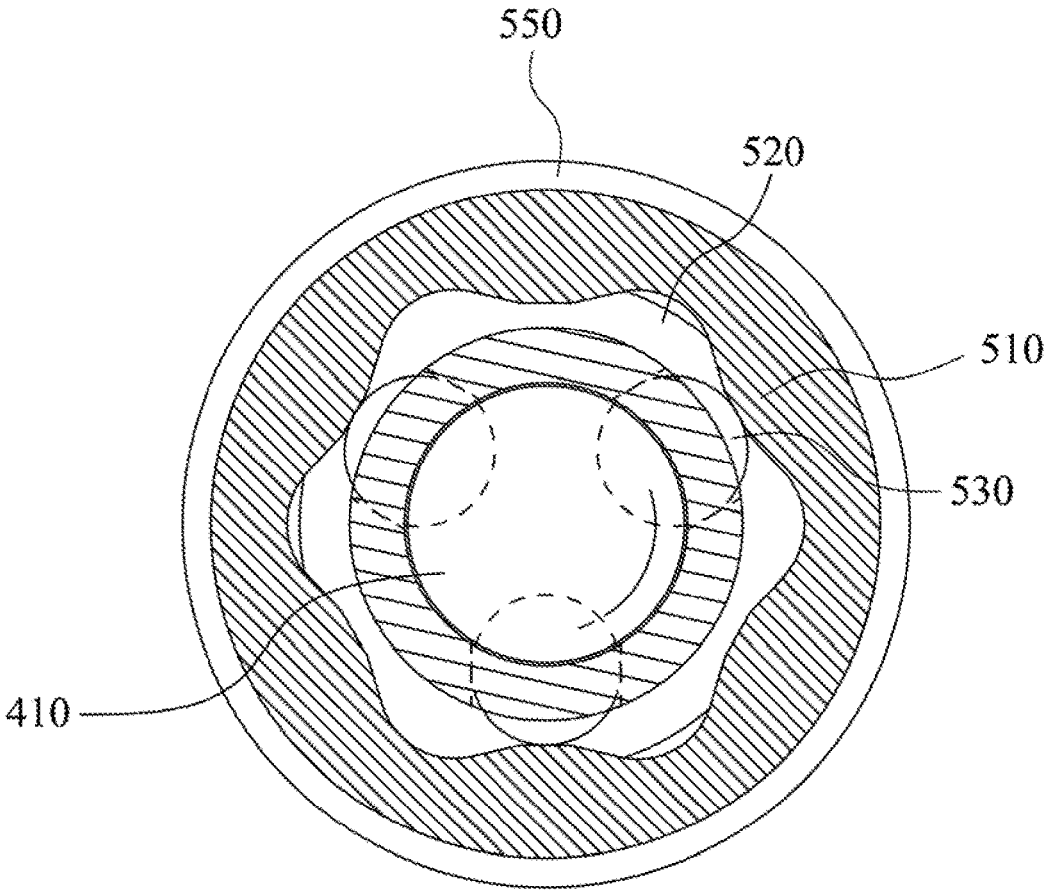
FIG. 5A shows a release status of the transmission member of FIG. 1.
Figure 5B:
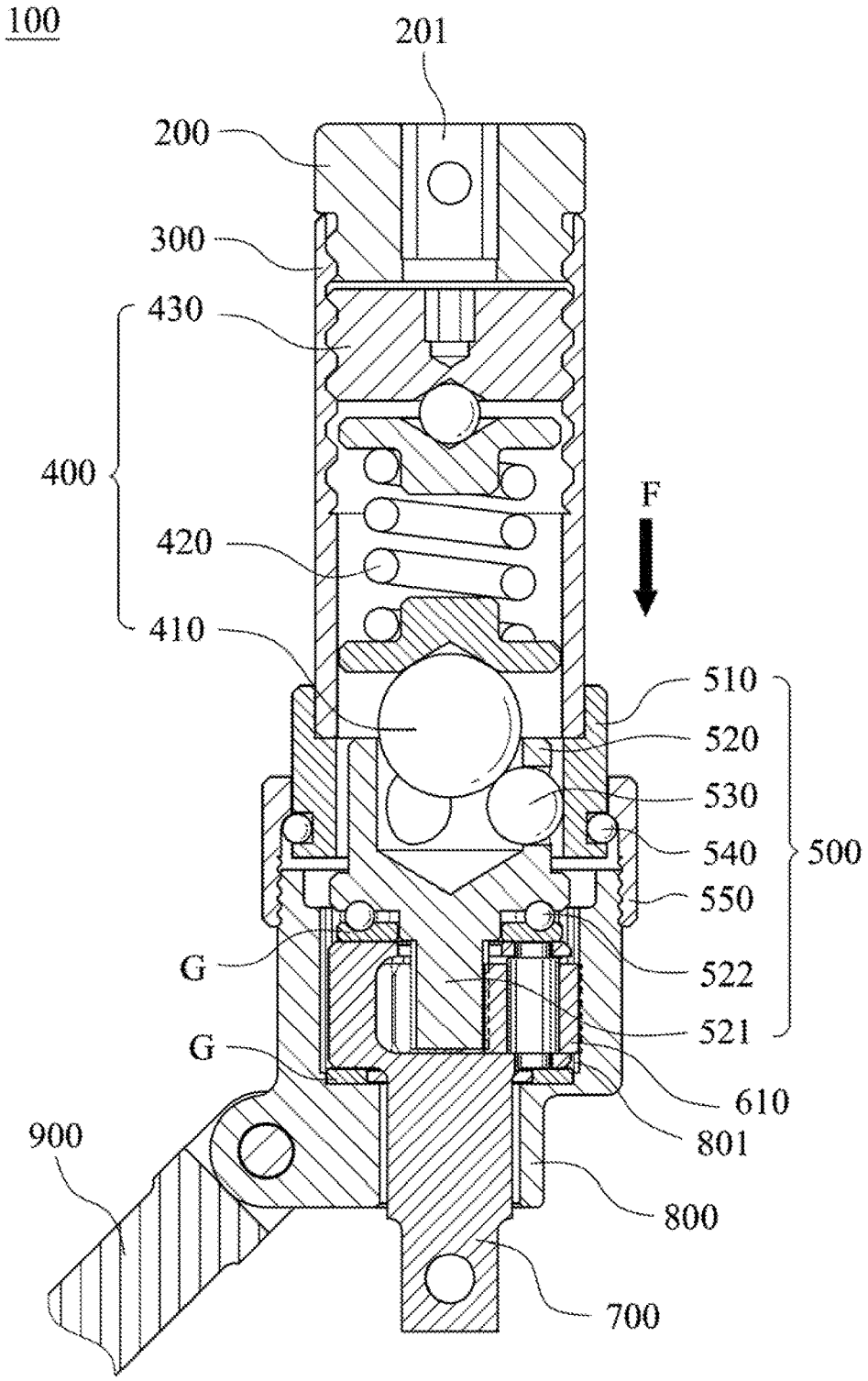
FIG. 5B is a cross-sectional view showing a torque release status of the torque socket of FIG. 5A.

FIG. 5A shows a release status of the transmission member 530 of FIG. 1; and FIG. 5B is a cross-sectional view showing a torque release status of the torque socket 100 of FIG. 5A.

In FIG. 5A, different from in FIG. 3, the transmission member 530 is released from the circular inner teeth of the driving member 510 and can slide freely. In FIG. 3, it is shown that the transmission member 530 moved to the groove of the transmission shaft 520 or not is determined by a balance between a push force that the driving member 510 exerts to the transmission member 530 and a pressing force of the release valve 410. In other word, when the adjusting member 430 compresses the elastic member 420 to a greater amount of compression, the restoring force F of the elastic member 420 is greater, thus the pressing force of the release valve 410 is greater. When a torque feedback from the torque output member 700 to the transmission shaft 520 reaches a pre-determined value, and the user still rotates the driving member 510, since the transmission shaft 520 has a greater rotation resistance, the transmission member 530 is pushed by the driving member 510 and is released from its inner tooth, thereby pushing the release valve 410. Thus, when a force that the transmission members 530 pushes the release valve 410 is equal to the restoring force F of the elastic member 410, the forces of the release valve 410 and the transmission members 530 are balanced. At the time, the pressing force of the release valve 410 loses effectiveness; the release valve 410 is pushed toward the elastic member 420 and is released.

The degree of the feedback torque depends on the adjustment of the elastic member 420. For example, if the restoring force F of the elastic member 520 is set to allow 200 pounds torque, when a torque feedback from the torque output member 700 is equal to 200 pounds, the torque will be increased when keep rotating the driving member 510. At the time, as shown in FIG. 5A, the driving member 510 and the transmission member 530 can be rolled tangentially, an a torque transmission exceeds 200 pounds will be failure, thereby automatically releasing the torque.

As to a side force that the driving member 510 exerts to the transmission member 530, and a relationship between the side force and the restoring force F, they will be influenced by the size and the location of the transmission member 530 and the release valve 410, the quantity of the transmission member 530, the elasticity coefficient of the elastic member 420, etc. However, the calculation of the aforementioned parameters is commonly known in the field of mechanics. Moreover, in the embodiment, although the quantity of the transmission member 530 and the torque gear 610 are both three, however, there is no limitation on the quantity of the transmission member 530 and the torque gear 610.

In sum, the torque socket of the present disclosure has the following advantages: (a) the torque socket combines the functionalities of the torque amplifier and automatic torque releasing, therefore it is convenient to operate and a torque value can be precisely measured; (b) a new mechanical structure of the torque socket is proposed for solving issues of the conventional torque amplifier. The torque socket of the present disclosure uses a simple release module for achieving automatic torque release functionality. The release procedure of the release valve and the transmission member is dynamically balanced, thereby achieving a stable operation, and a vibration caused by the spring will be reduced; (c) by the automatic release mechanism of the torque socket, the torque value can be ensured in each working step, therefore, the torque socket of the present is suitable for the equipment that requires high assembling precision and is capable of adjusting torque value according to various situations; (d) the release mechanism is integrated in the torque socket, and the torque release procedure has no mechanical wear and can be used for long periods of time without changing consumable materials.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A torque socket, comprising:

an input base comprising an input end, wherein the input end is connectable to a hand tool, and the input base is rotated by the hand tool;

a transmission module, comprising:

a driving member connected and activated by the input base;

a transmission shaft accommodated in the driving member, wherein one end of the transmission shaft comprises a transmission gear; and a plurality of transmission members limited by the transmission shaft, wherein the transmission members are linked with the driving member to rotate the transmission shaft;

a release valve against the transmission members and moved by the transmission members;

a plurality of torque gears limited by the torque socket, wherein the torque gears are disposed around the transmission shaft and are engaged with the transmission gear, the torque gears are linked by the transmission gear and are revolved around the transmission shaft;

a torque output member comprising an accommodating space for supporting the torque gears; and a guiding base comprising annular gears, wherein the transmission shaft is rotatably coupled to the guiding base, and the torque gears revolve against the annular gears thereby rotating the torque output member.

2. The torque socket of claim 1, wherein the transmission shaft is accommodated in the guiding base.

3. The torque socket of claim 2, wherein the torque gears are located between the guiding base and the transmission gear, the torque gears are engaged with the guiding base and are moved by the guiding base.

4. The torque socket of claim 1, wherein the input end, the transmission shaft and the torque output member are disposed coaxially.

5. The torque socket of claim 1, further comprising:

a positioning arm connected to the guiding base, wherein the guiding base is positioned by the positioning arm.

6. A torque socket, comprising:

an input base comprising an input end, wherein the input end is connectable to a hand tool, and the input base is rotated by the hand tool;

a transmission module, comprising:

a driving member connected and activated by the input base;

a transmission shaft accommodated in the driving member, wherein one end of the transmission shaft comprises a transmission gear; and a plurality of transmission members limited by the transmission shaft, wherein the transmission members are linked with the driving member to rotate the transmission shaft;

a release mechanism located between the input base and the transmission shaft, the release mechanism comprising:

a release valve against the transmission members and moved by the transmission members;

an elastic member against the release valve and comprising a restoring force; and an adjusting member against the elastic member, wherein the adjusting member is moved to adjust the restoring force;

a plurality of torque gears limited by the torque socket, wherein the torque gears are disposed around the transmission shaft and are engaged with the transmission gear, the torque gears are linked by the transmission gear and are revolved around the transmission shaft; and a torque output member comprising an accommodating space for supporting the torque gear; and a guiding base comprising annular gears, wherein the transmission shaft is rotatably coupled to the guiding base, and the torque gears revolve against the annular gears thereby rotating the torque output member.

7. The torque socket of claim 6, wherein the transmission shaft is accommodated in the guiding base.

8. The torque socket of claim 7, wherein the torque gears are located between the guiding base and the transmission gear, the torque gears are engaged with the guiding base and are moved by the guiding base.

9. The torque socket of claim 6, wherein the transmission members and the elastic member are disposed opposite to the release valve.

10. The torque socket of claim 6, wherein the input end, the transmission shaft and the torque output member are disposed coaxially.

11. The torque socket of claim 6, further comprising:

a positioning arm connected to the guiding base, wherein the guiding base is positioned by the positioning arm.

* * * * *